US007922492B2

(12) United States Patent
Nielsen et al.

(10) Patent No.: US 7,922,492 B2
(45) Date of Patent: Apr. 12, 2011

(54) SYSTEM OF STAGING PROPS FOR SIMULATING STAGING FURNITURE AND METHOD OF USING SAME

(75) Inventors: Kevin Nielsen, Olympia, WA (US); Karen Nielsen, Olympia, WA (US); Jeff Waltrip, Sioux Falls, SD (US)

(73) Assignee: Nextstage Furniture, Inc., Sioux Falls, SD (US)

( * ) Notice: Subject to any disclaimer, the term of this patent is extended or adjusted under 35 U.S.C. 154(b) by 497 days.

(21) Appl. No.: 12/062,432

(22) Filed: Apr. 3, 2008

(65) Prior Publication Data

US 2009/0251034 A1 Oct. 8, 2009

(51) Int. Cl.
*G09B 25/00* (2006.01)

(52) U.S. Cl. ..... 434/80

(58) Field of Classification Search ..... 434/72, 434/79, 80, 365, 382; 446/476, 478, 479
See application file for complete search history.

(56) References Cited

U.S. PATENT DOCUMENTS

| | | | | |
|---|---|---|---|---|
| 3,012,336 | A * | 12/1961 | Brown | 434/80 |
| 3,669,494 | A | 6/1972 | Lohmeyer | |
| 3,811,728 | A | 5/1974 | Redemske | |
| 4,053,192 | A | 10/1977 | Spetner | |
| 4,463,997 | A | 8/1984 | Densen | |
| 4,526,548 | A | 7/1985 | Livingston | |
| 4,626,218 | A * | 12/1986 | Wright | 434/73 |
| 5,141,437 | A * | 8/1992 | Fowlkes, Jr. | 434/72 |
| 5,904,410 | A | 5/1999 | Davies | |
| 6,782,119 | B1 * | 8/2004 | Barlett | 382/113 |
| D536,378 | S * | 2/2007 | Taff | D19/62 |
| 7,537,453 | B2 * | 5/2009 | Morgan et al. | 434/80 |
| 2004/0226492 | A1 | 11/2004 | Carter | |
| 2005/0202393 | A1 | 9/2005 | Morgan et al. | |
| 2005/0208866 | A1 | 9/2005 | Karabees | |
| 2005/0277093 | A1 * | 12/2005 | Kelly et al. | 434/80 |
| 2007/0052276 | A1 | 3/2007 | Hurvich | |
| 2007/0190496 | A1 * | 8/2007 | Lamb | 434/72 |

* cited by examiner

*Primary Examiner* — Kurt Fernstrom
(74) *Attorney, Agent, or Firm* — Fulwider Patton LLP

(57) ABSTRACT

A method of involving the erection of foldable flat blanks to construct tubes of predetermined configurations for assembly in combination to form respective mannequin devices to, when draped with a selected cover, simulate furniture to stage a property.

The device of the present invention includes one or more blanks in the form of flatten tubes, erected into tubular components and assembled together to simulate the shape of furniture pieces and which may be draped with a fitted cover to mock the desired furniture piece.

17 Claims, 10 Drawing Sheets

FIG.14
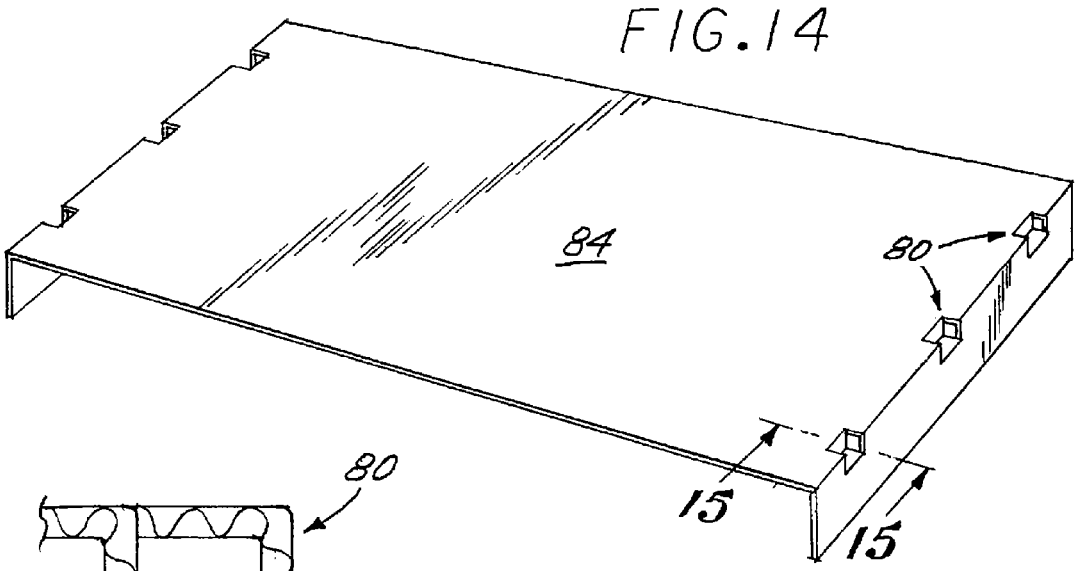
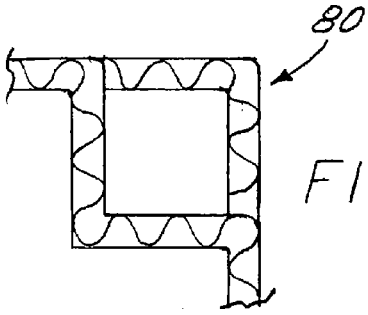
FIG.15
FIG.16
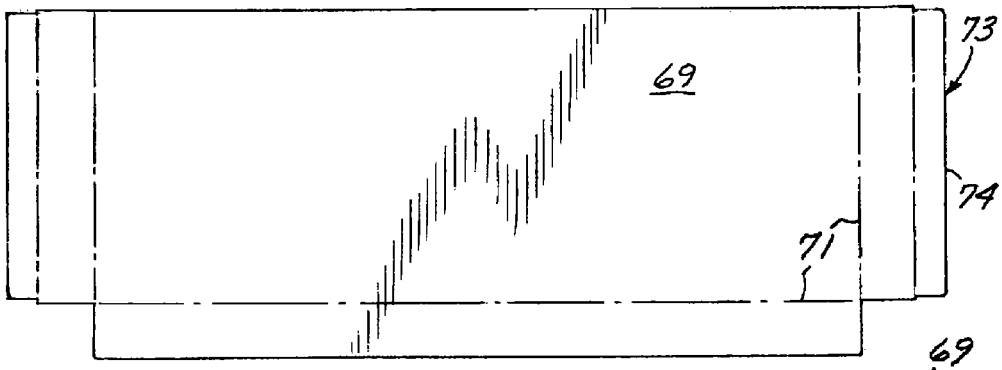
FIG.17
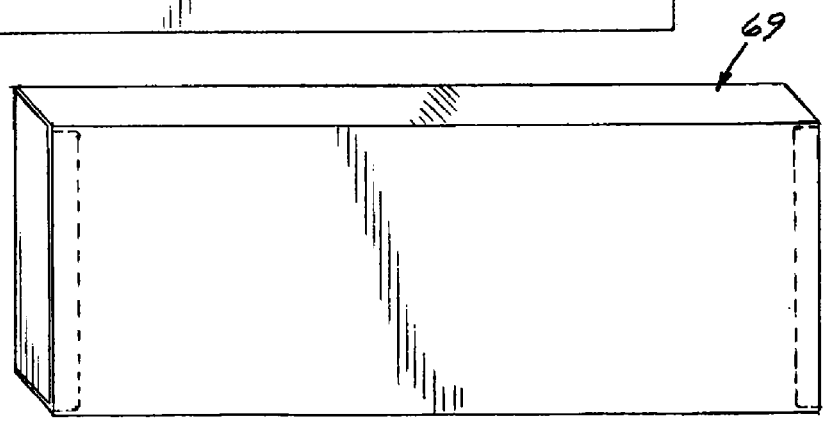

80
84
85
86
83
61
23
24

FIG. 26
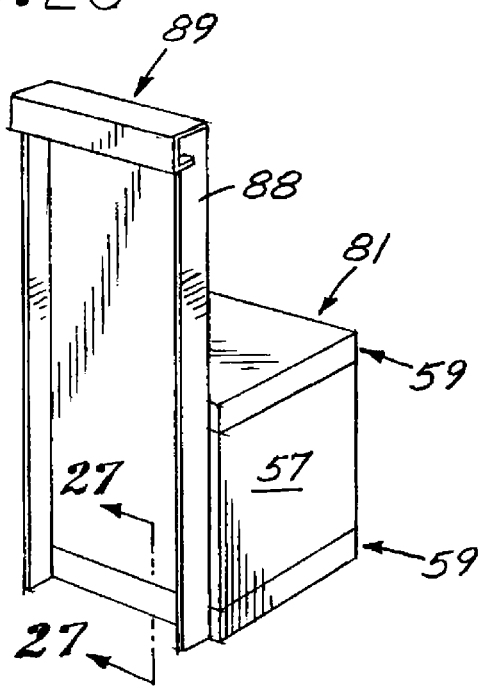
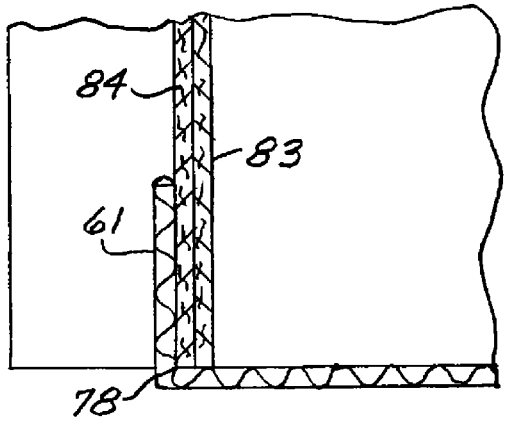
FIG. 27
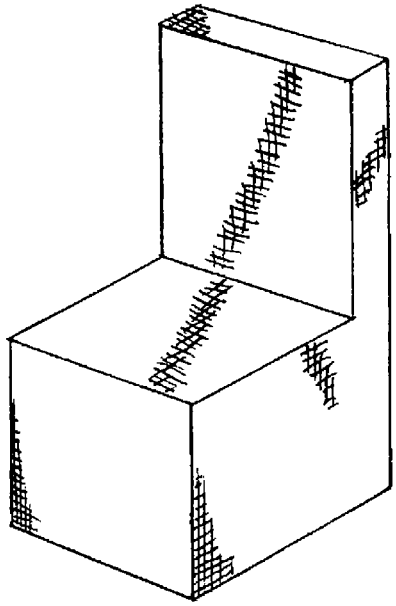
FIG. 28
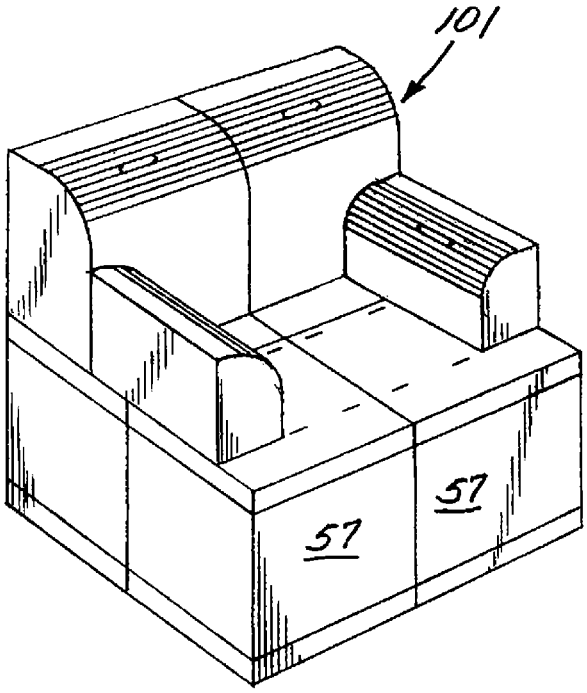
FIG. 29

SYSTEM OF STAGING PROPS FOR SIMULATING STAGING FURNITURE AND METHOD OF USING SAME

BACKGROUND

1. Field of the Invention

The present invention relates to the marketing of real estate and particularly to staging of furniture to render the setting attractive to potential buyers.

2. Description of the Prior Art

In the present day real estate market any edge a seller can obtain for enhancing the attractiveness of a residence for sale is important in that it can act to make the difference between the residence languishing on the market or attracting fast and multiple offers. Traditionally, model homes and condominiums have relied on relatively expensive traditional furniture to set the décor for different living quarters of a house placed on the market. In recognition of the need for selecting attractive furnishings to render the real estate more attractive to would be buyers, Barb Schwartz of Seattle, Wash., in 1972, introduced what is termed staging when furniture pieces are selected to arrange in the living area to render properties more attractive. From this an entire industry of, "stagers", has grown up where they hire themselves out as experts temporarily to furnish a property in a manner that will be appealing to the purchasing public. Staging has been a growth industry since its inception to the point where it is now employed in some 5% of United States residential sales. Data shows that properties which are staged sell faster and at a higher price. A typical service staging with presentable traditional furniture can run $700.00-$800.00 per listing per month. Thus, hereto for broker or owner has been faced with the dilemma of being forced to either pay the high fees associated with staging traditional furniture or incurring the risk of a slow sale or possibly no sale at all. Consequently, there is a great demand for anything that can be done to reduce the capital investment for the props and reduce the labor and transportation costs for staging pieces and the display thereof.

The furniture presently used by stagers is either purchased or rented at a high price for some combination thereof and is sometimes reused. Traditional furniture, such as tables, couches, chairs and the like are relatively expensive and of considerable weight and size which renders the furniture sets themselves inconvenient to move and store. Traditional furniture is typically style specific and thus does not lend directly to use for various styles of architecture and tastes. When it goes out of style or becomes worn, it will readily be condemned to long term storage or a landfill. Thus, there persists a problem in seeking to stage a house in a convenient and inexpensive manner. The problem is more acute due to the different styles of property being displayed throughout the market and the differing tastes of the would be buyers.

In an unrelated art, many efforts have been made in the past to provide modular furniture which may be made up of individual modules connected together by different styles of releasable joints. Other efforts have led to the proposal that a piece of model furniture be constructed of foldable cardboard material which is constructed of various panels foldable into a closure with the panels having photographs or other graphics thereon to simulate traditional furniture. A device of this type is shown in U.S. Pat. No. 5,904,410 to Davies.

Such devices, while satisfactory for their intended purpose, do not lend themselves to assembly in a compound configuration to form a mannequin to simulate particular furniture pieces and which may be draped by a curtain, cover or the like to faithfully exhibit the desired look.

In unrelated art, it has also been proposed to provide a knock down storage unit constructed from foldable one piece blanks which incorporate interlocking flaps so that the blanks may be folded to form a closed structure with individual horizontal compartments for receipt of items to be stored and which are dedicated to simulate specific furniture piece to thus conceal the true purpose of the storage unit. A device of this type is shown in U.S. Pat. No. 4,463,997 to Densen. While satisfactory for storage units, such devices are relatively complex to manufacture, cumbersome to erect and are each limited to simulating only a specified furniture piece.

Thus, there exists a need for a method of utilizing collapsible props which may be conveniently erected and assembled in different ways to form selected profile frameworks to act as mannequins which may be draped or otherwise covered to simulate pieces of furniture such as a table, couch, chair or the like.

SUMMARY OF THE INVENTION

The method of the present invention is intended to facilitate the staging of furniture at a staging site such as a residence or the like to favorably adorn the various rooms of the house to thereby simulate the furniture that would normally be in place within the living quarters. This method lends itself favorably to the assembly and display of numerous different styles and shapes of furniture pieces and can readily disassembled, flatten and stored.

The apparatus of the invention includes flat blanks erectable as tubular components to be assembled in selected combination to cooperate in defining respective mannequin simulating the shape of respective furniture pieces.

BRIEF DESCRIPTION OF THE DRAWINGS

FIG. 14 is a perspective view of the table top blank shown in FIG. 13 with the aprons at the opposite ends folded down;

FIG. 15 is a vertical sectional, in an enlarged scale, taken along the line 15-15 in FIG. 14;

FIG. 16 is a top plan view of a tubular blank for a desk top which may be used in the method of the present invention;

FIG. 17 is a perspective view of the tubular blank shown in FIG. 16 erected along the fold lines;

FIG. 26 is a perspective view of a dining chair, in a reduced scale, incorporating the back component shown in FIG. 10;

FIG. 27 is a vertical sectional view, in enlarged scale, taken along the line 27-27 of FIG. 26;

FIG. 28 is a front perspective view of the chair of FIG. 26 but with a fitted cover thereover;

FIG. 29 is a front perspective view of a love seat incorporating the arm rests shown in FIGS. 11 and 12 but in reduced scale;

DETAILED DESCRIPTION OF THE PREFERRED EMBODIMENTS

Figure 18:
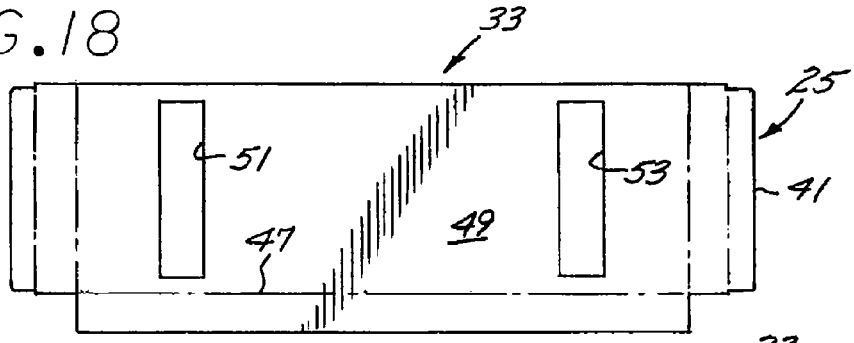
FIG. 18 is a top plan view of a moldable tubular blank which may be employed to construct a console top which may be utilized in the method of the present invention.
Figure 19:
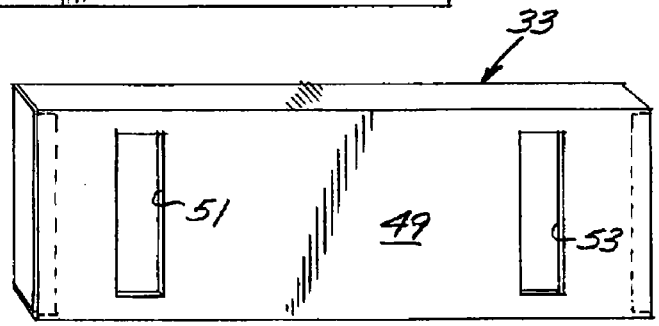
FIG. 19 is a perspective bottom view of the blank shown in FIG. 18 but erected.

The method of the present of invention includes, generally, the selection of a plurality of flat tubular blanks 21, 23 and 25 (FIGS. 18-20) which may be constructed of corrugated cardboard and formed with selected fold lines 47 and, in some cases end flaps, generally designated 25, which may be folded on themselves to form end walls so that the blanks can be unfolded and assembled to form respective tubes which define vertical columns forming, for instance, the legs of a console, generally designated 31, and the top thereof. The top piece blank 33 may be erected and mounted on the legs 21 and 23 to thus cooperate in providing a mannequin which exhibits the shape and configuration of the furniture piece such as a console. In the preferred embodiment, such mannequins are then typically draped with a cover which, may be fitted form, to be displayed as a table cloth or cover.

Often times the manner in which a residence is presented for sale is the key to making the sale. This is particularly true in a time when sales are slow and potential buyers have a wide selection of properties to consider so may well require an extra motivation for selecting the particular property in these selections. The demand has become so great, firms have even come to specialize in setting up the staging for realtors or owners in effort to add to the attraction of the property and customize the appeal to the market segment or may be even to the character of the property itself. It has been common practice to purchase and display new furniture in model homes or in a residence placed on the market to thus appeal to the shopper's preferences. This has proven to be an expensive, time consuming and often times back breaking endeavor. The furniture itself is expensive, heavy and inconvenient to move and requires considerable space for storage between staging events. The present invention focuses on this problem in providing self contained, collapsible inexpensive props which may be conveniently erected and assembled for simulating authentic furniture pieces and which provides an attractive appearance and enjoys the additional feature in that it the method allows for the simulating props to be reused.

Turning back to FIGS. 18-21, the tubular blanks 21, 23 and 33 are generally in the form of right quadrangles including the longitudinal fold line 47 which allow for the blanks 21 and 23 to be deployed to right quadrangular shape as shown in FIG. 20.

The blanks 21 and 23 may be formed on their opposite ends with integral sets of flaps 25 which may be in the form of major flaps projecting laterally and minor flaps which fold over from the sides to cooperate in forming a self contained tubular shape with structural integrity and wherein the ends are themselves capped off to enhance the structural rigidity of the device itself. In other embodiments, single flaps comparable to those shown in FIG. 16 are employed.

The blank 33 is formed with a bottom wall 49 which is configured with laterally spaced apart, transversely projecting rectangular slots defining openings of 51 and 53 configured to telescopically receive the upper extremities of the respective legs 21 and 23.

Figure 1:
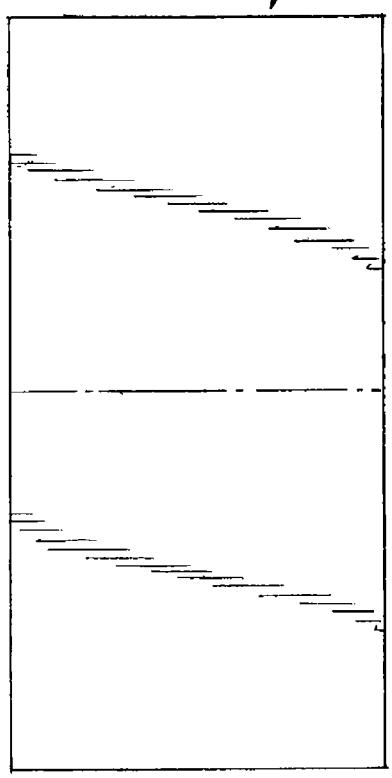
FIG. 1 is a top plan view of a foldable blank which may be erected in a tube to be utilized in the method of the present invention.
Figure 4:
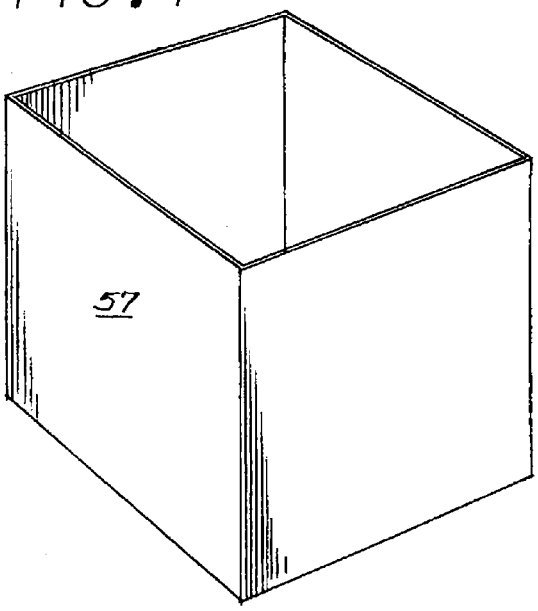
FIG. 4 is perspective view of the foldable blank shown in FIG. 1 erected to form the tube.
Figure 5:
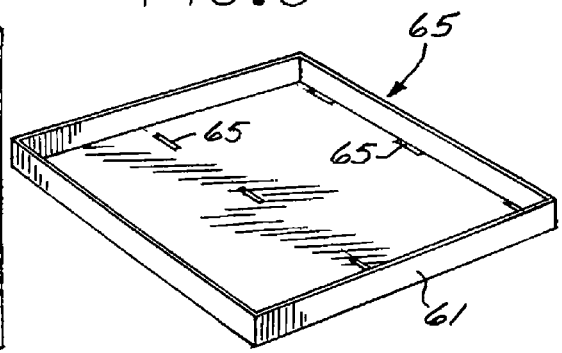
FIG. 5 is a perspective view of the cap blank shown in FIG. 2 with the peripheral walls thereof erected.
Figure 6:
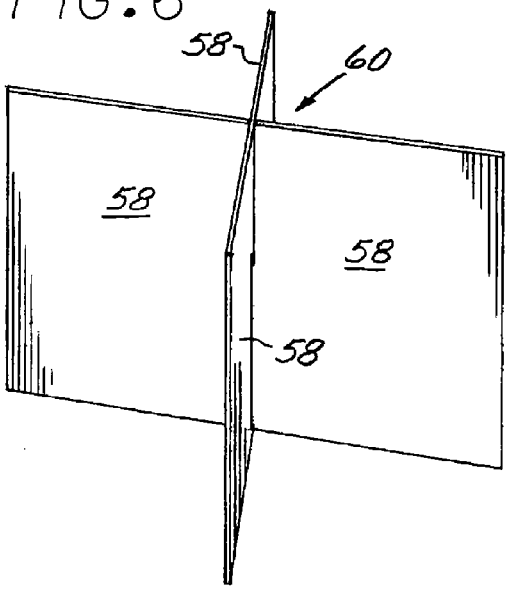
FIG. 6 is a perspective view of a reinforcing insert constructed from panels like that shown in FIG. 3 but of a reduced scale.

Referring to FIGS. 1 and 4, in some embodiments, our method includes the selection of the flat blanks 57 which may be erected to establish generally square shaped vertical columns defining chair, table or desk legs which may be capped at one or both ends by respective trays defining caps, generally designated 59.

The blanks 57 may be constructed of many different shapes and sizes but for chairs or the like will typically be in cube shape, about 18 inches on a side. To simulate a desk or the like they will be longer.

Figure 2:
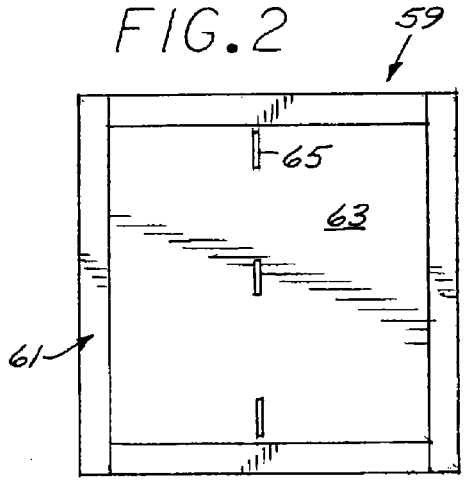
FIG. 2 is a top plan view of a cap blank which may be erected to be fitted on a tube erected pursuant to the method of the present invention.
Figure 3:
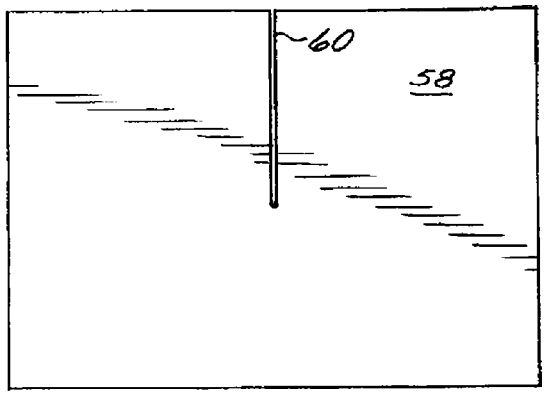
FIG. 3 is a stiffener panel to be incorporated in stiffener device which may be utilized with the method of the present invention.

The cap trays 59 are formed from flat blanks (FIG. 2) configured with fold lines defining square outlines and to form peripheral vertical walls 61 circumscribing respective end walls 63. The planer end walls 63 are for reasons which will become apparent hereinafter, formed with a plurality of through elongated slots 65 disposed thereabout in a predetermined configuration. In the embodiment shown in FIG. 21, we elect to provide top and bottom trays 59 to cap off both top and bottom of the respective tubular blanks 57 to define legs.

With continued reference to FIGS. 16 and 17, we provide a tubular blank 69 to define a desk top panel. The blank is formed with longitudinal and transverse fold lines 71 and includes on its opposite sides respective short flaps, generally designated 73, which are configured at their free ends with tongues 74 to be inserted in folded relation to lock the flaps removably in place.

Figure 21:
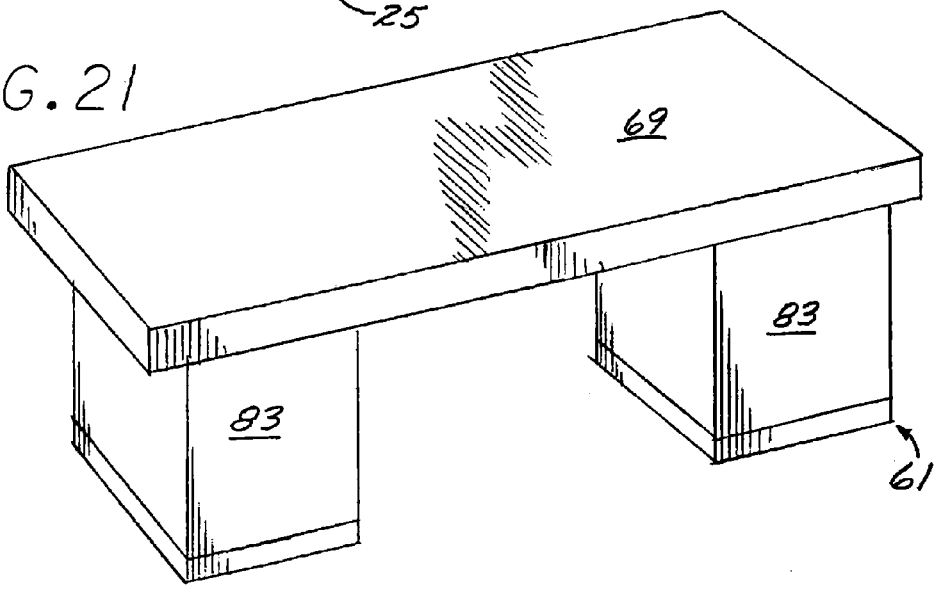
FIG. 21 is a perspective view of a desk constructed pursuant to the present invention employing the tubular constructions similar to FIG. 4 but in reduced scale.

Referring to FIG. 21, in one preferred embodiment, we select tubular blanks similar to blanks 52 but longer and having fold lines to be erected with a rectangular horizontal cross section to when erected form a pair of relatively tall spaced apart legs 83.

Thus, it will be appreciated that the blanks may typically be stored in a folded and flattened configuration to be withdrawn and transferred to the staging site where there may be assembled and erected as shown to form a mannequin suggestive of a desk construction (FIG. 21). In most applications, the desk will be covered by a table cloth defining a cover so as to even more convincingly simulate the furniture piece.

Figure 9:
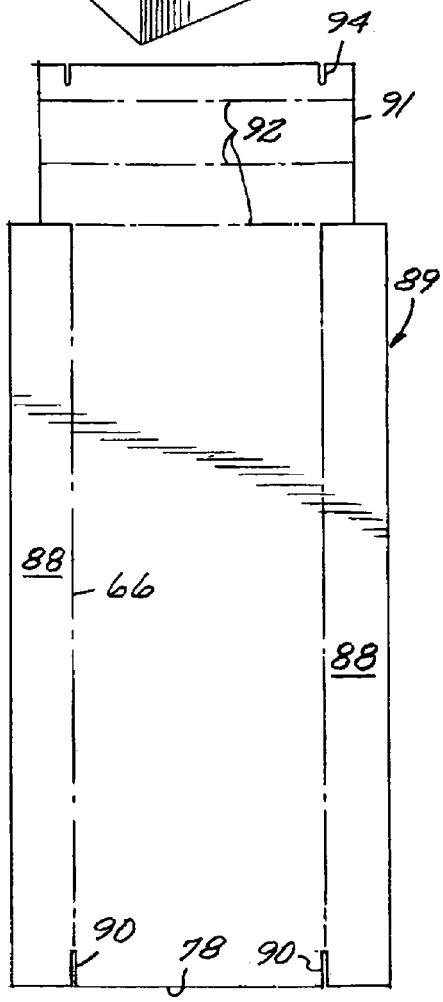
FIG. 9 is a top plan view of a foldable panel erectable to form a chair back.

Referring to FIGS. 9 and 26, in one preferred embodiment our method employs the tubular blank 57 in constructing a dinning room chair, generally designated 81. The back of the chair is formed by a blank, generally designated 89 formed with longitudinal fold lines 66 spaced laterally apart to define at the opposite sides thereof, sidewalls 88 which may be folded rearwardly as shown in FIG. 26 to cooperate with the back wall to form a channel shape. The blank 89 is formed in its bottom margin with a pair of downwardly opening longitudinal slots 90 interposed in the fold lines 66 and cooperating to form a central longitudinal tongue 78. The blank is formed at the upper extremity with a longitudinally projecting tongue 91 having laterally projecting, longitudinally spaced apart fold lines 92 and configured at its terminal extremity with a pair of laterally spaced apart open ended slots 94.

In assembly, it will be appreciated that the blank 89 may be mounted to the back of the chair tube 57 by folding along the lines 66 to define the channel shape shown in FIG. 26 and then inserting the tongue 78 in the space between the back wall of the chair tube 57 and the peripheral wall 61 of the bottom tray 59 to be tucked into position. The upper tongue 91 may be folded rearwardly over the top edges of the respective side walls 88, turned down along the back edge thereof and the slots 94 fitted over the respective free edges of such side walls (FIG. 26). In the final construction, the air mannequin may be covered by the fitted chair cover shown in FIG. 28.

Referring to FIGS. 11, 12, 26, 29 and 32, in one embodiment our method involves assembly of the tubular components to form a love seat and couch, generally designated 101 and 103, respectively. The couch 103 (FIG. 32) is made up of two rows of foldable blanks 57 unfolded along fold lines to form the tubes which are capped on their top and bottom sides by the caps 59. The tubes 57 are conveniently arranged in two rows of three disposed in juxtaposition.

Figure 11:
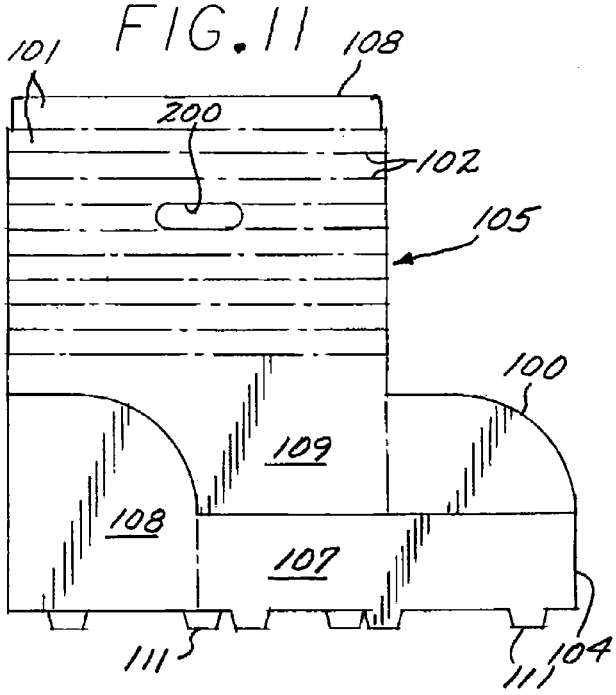
FIG. 11 is a perspective view of a flat blank erected to form an arm reset of a couch.
Figure 12:
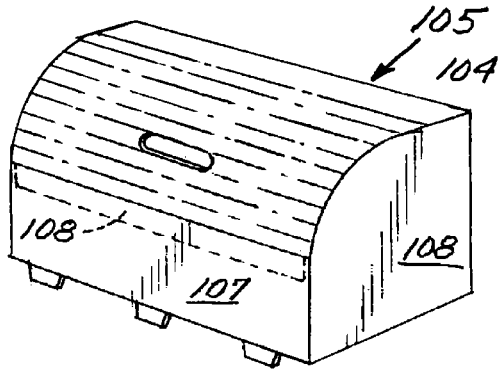
FIG. 12 is a perspective of the arm rest blank shown in FIG. 11 but with the top flap folded down.

Referring to FIGS. 11 and 12, two arm rest tubular tubes, generally designated 105 are constructed from foldable flat panels formed with fold lines 104 which, when the panels are distended, serve to form respective rectangularly shaped boxes formed with respective front side and back walls 107, 108 and 109. The front wall 107 is shorter than the back wall 109 and the side walls 108 extend horizontally from the back wall 99 and curve downwardly in arcuate fashion to join the top edge of the front wall 107. A cap flap 101 is formed integrally with the back wall 109 projects upwardly therefrom and includes a plurality of parallel, horizontally projecting fold lines 103 to allow for the cap flap to be folded downwardly over the curved edges 100 to the position shown in FIG. 12. The flap 101 is conveniently formed centrally with a through slot 200 and terminates in a fastener tongue 108. Formed along the bottom edges of the front and back walls 107 and 109 are downwardly projecting fastener tabs 111 arranged in the predetermined configuration corresponding with the configuration of the slots 65 in the caps 59 for convenient removable fastening thereof to such caps.

With continued reference to FIG. 15, vertical back rests, generally designated 115, of a construction similar to the arm rests 105 are constructed from elongated tubular flat blanks formed with fold line 117 configured such that the blanks may be erected to form respective quadrangular tubes as shown in FIG. 11. Similar to the construction shown in FIG. 11, the top edges of the side walls of such back sections are curved downwardly and forwardly and respective flaps, generally designated 119 formed integrally with back walls are laid down over the curved portions and include the respective tongues tucked in behind the respective front walls.

Thus, the respective foldable blanks may be withdrawn from storage and removed from their packaging and assembled at the staging site. The respective tubes 57 forming the chair part of the couch may be positioned on respective caps 59 and the tubes drawn together in two lines of three as depicted. The cruciform reinforcing inserts 60 may then be inserted in each of the tubes 57 and the tubes capped off by the caps 59.

The blanks 115 to form the back support tubes may be then erected and stacked on the rear most row of tubes 57 with the fastener tabs corresponding with the tabs 111 received frictionally in the respective slots 65 of the caps to removably lock the back tubes on 15 in place. The blanks forming the arm rests 105 may also be drawn from their packaging and deployed with the flap 102 drawn downwardly over the curved edge 100 and the tongue 108 inserted behind the top edge of the front wall 107 to lock the flap in position. Thereafter, a fitted cover may be unfolded and installed over the mannequin formed by the affirmation components to faithfully simulate a couch in the living room area.

Figure 30:
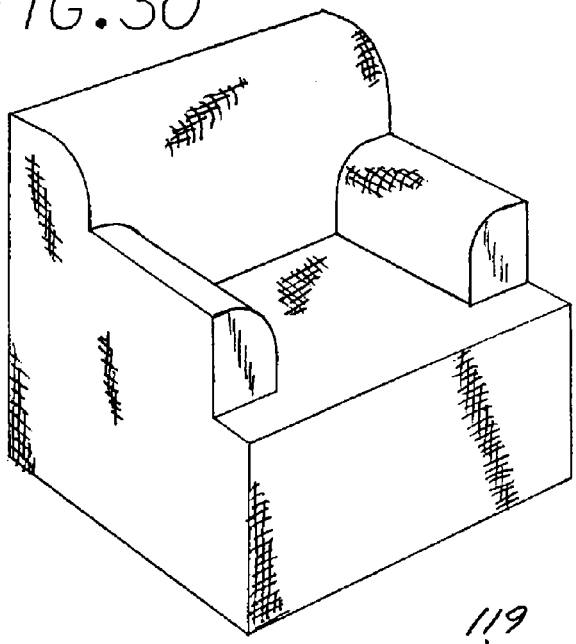
FIG. 30 is a front perspective view of the love seat shown in FIG. 29 but fitted with a cover.

For the love seat 101, the assembly is similar to that for the couch 105 and the final mannequin is shown in FIG. 29 can be covered with a cover as shown in FIG. 30.

Figure 13:
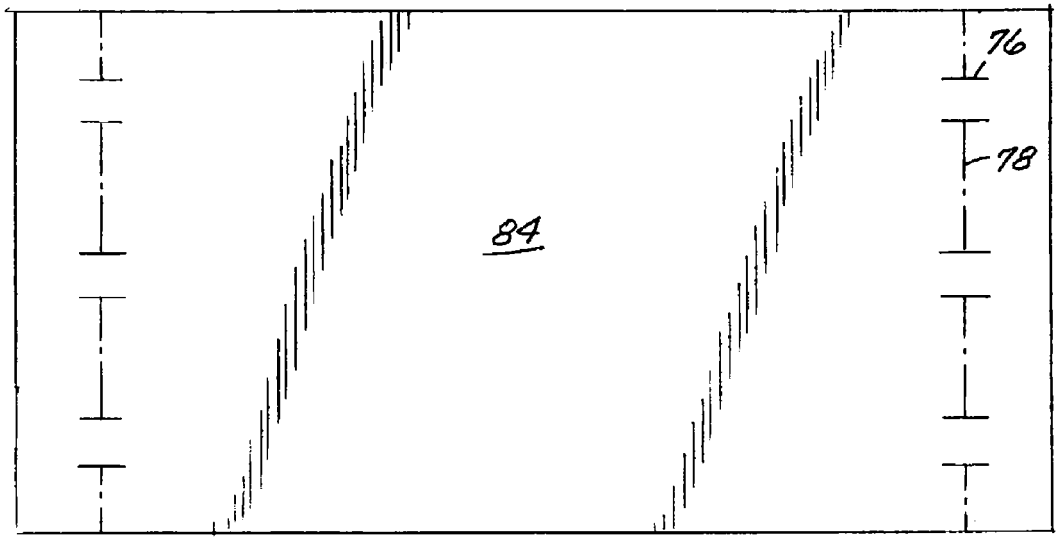
FIG. 13 is a top view of flat foldable blank which may be incorporated in a table top.
Figures 22, 23, 24, 25:
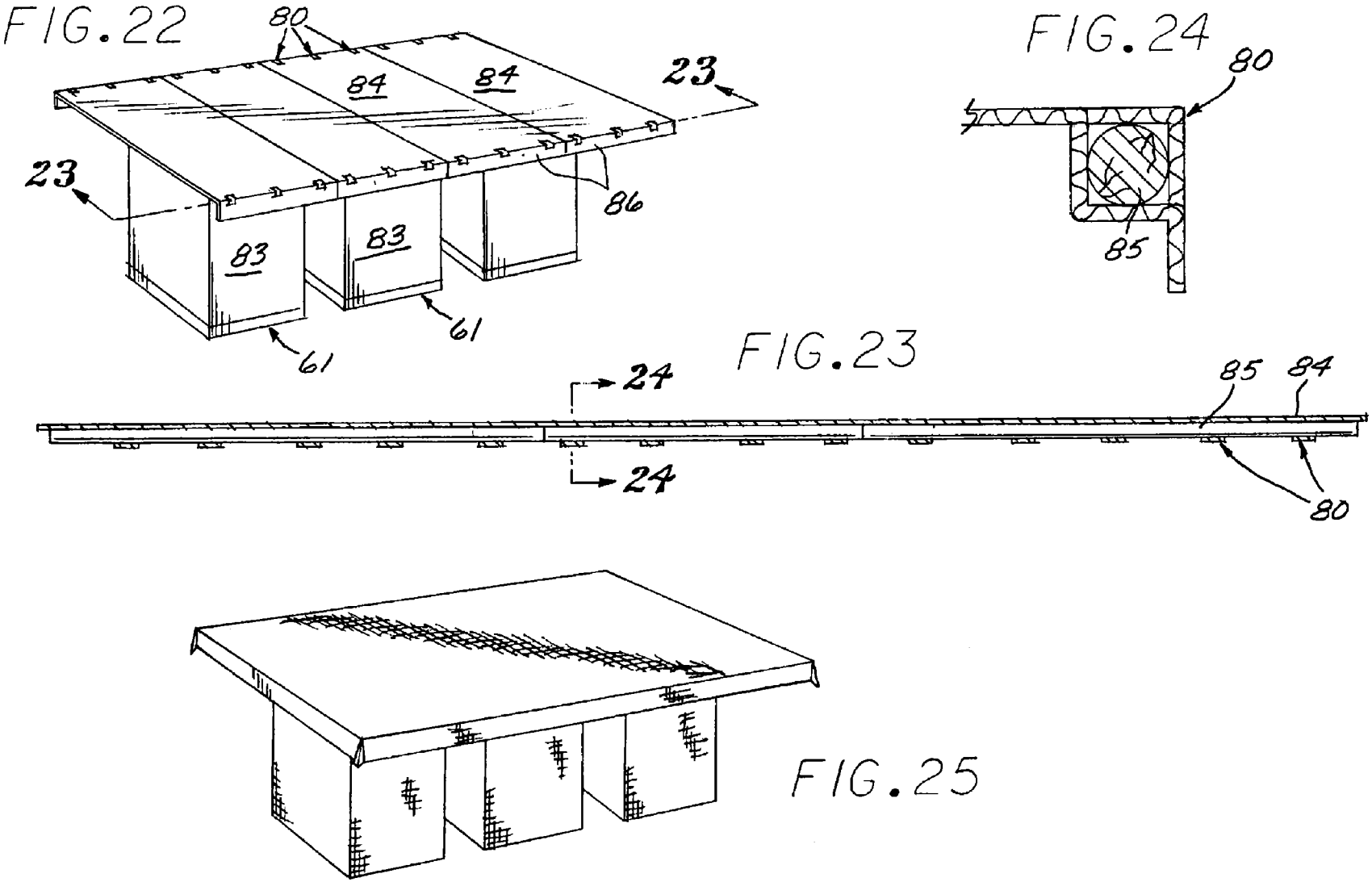
FIG. 22 is a perspective view of a table which may be utilized in the method of the present invention and employing the table top shown in FIG. 14 but in reduced scale.
FIG. 23 is a longitudinal sectional view, in enlarged scale, taken along the line 23-23 of FIG. 22.
FIG. 24 is a vertical sectional view, in enlarged scale, taken along the line 24-24 of FIG. 23.
FIG. 25 is a perspective view similar to FIG. 22 but depicting the table top and legs draped with fitted covers.

Referring to FIG. 13, we have for one embodiment of our method, a plurality of flat, foldable blanks 84 configured along there opposite marginal ends with transverse fold lines 78 intercepted with pairs of short close spaced longitudinal cuts 76 which interrupt the fold lines 78 to form narrow hands that may be folded away from the body thereof to form the square open ended aligned rings 80 as shown in FIGS. 22 and 24.

Thus, the leg blanks 83 may be erected as shown in FIG. 22 and a series of, for instance, four panels 84 rested thereon in flanking relationship and the aprons at the opposite extremities of such blanks folded downwardly as shown with the bands between the cuts 76 punched out to form the respective rings 80. Thus, a stiffening dowel 85 may be inserted longitudinally through the respective rings of the flanking panels 84 for stiffening thereof. The legs and table tops may be covered with respective fitted covers as shown in FIG. 25.

Figure 31:
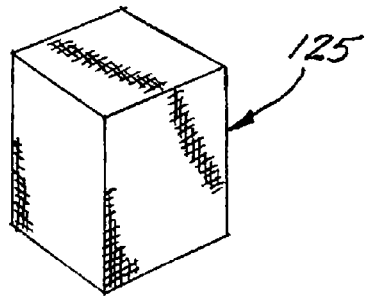
FIG. 31 is a front perspective view of a night stand, in reduced scale, erected from a tubular blank like that shown in FIG. 8 but fitted with a cover.

Referring to FIG. 31, we conveniently provide a tubular flat blank 83 which is erected and covered with a cover to simulate a night stand, generally designated 125.

Figure 10:
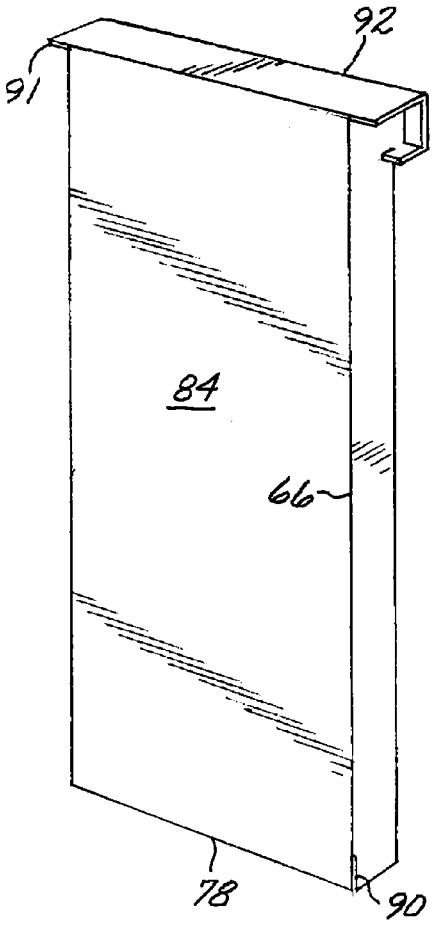
FIG. 10 is a perspective view of the foldable panel shown in FIG. 9 erected.
Figure 33:
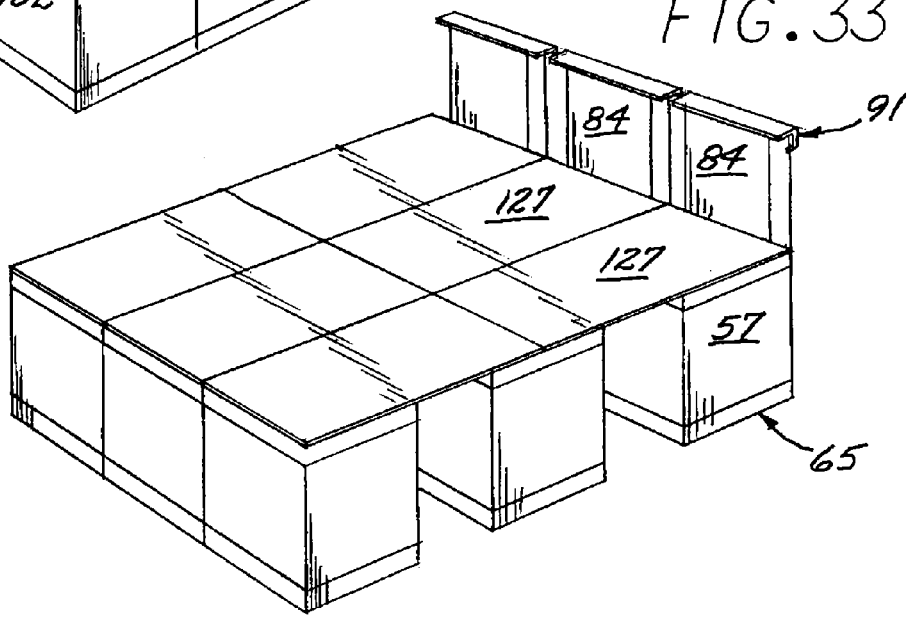
FIG. 33 is a simulated king size bed, in reduced scale, constructed of the erected tubular blanks shown in FIG. 8 and back blanks shown in FIG. 10.

Referring to FIG. 33, it will be appreciated that in one of our preferred embodiments we assemble a king size bed mannequin including a plurality of erected chair height blanks 57 capped with the caps 65 in the top and bottom and covered on the top with flat blanks 127. Mounted at the head of the bed are three flanking blanks 84 folded and erected similar to those shown in FIG. 10 for the back of the chair.

Figure 34:
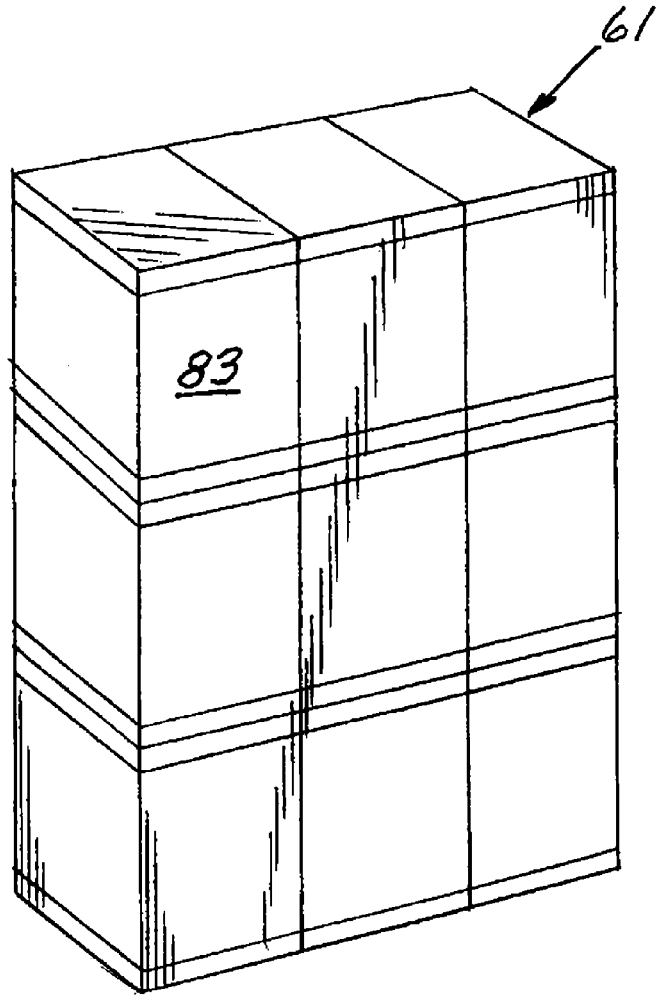
FIG. 34 is a perspective view, in reduced scale, of a stack of erected tubular elements as shown in FIG. 9 and arranged to simulate a armoire.
Figure 35:
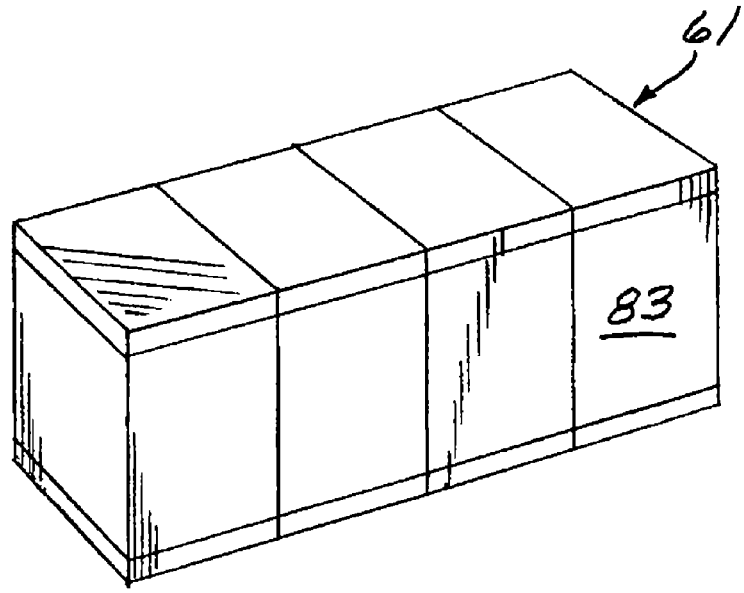
FIG. 35 is a perspective view, in reduced scale, of a dresser constructed of erected tubular blanks similar to those shown in FIG. 8.
Figure 36:
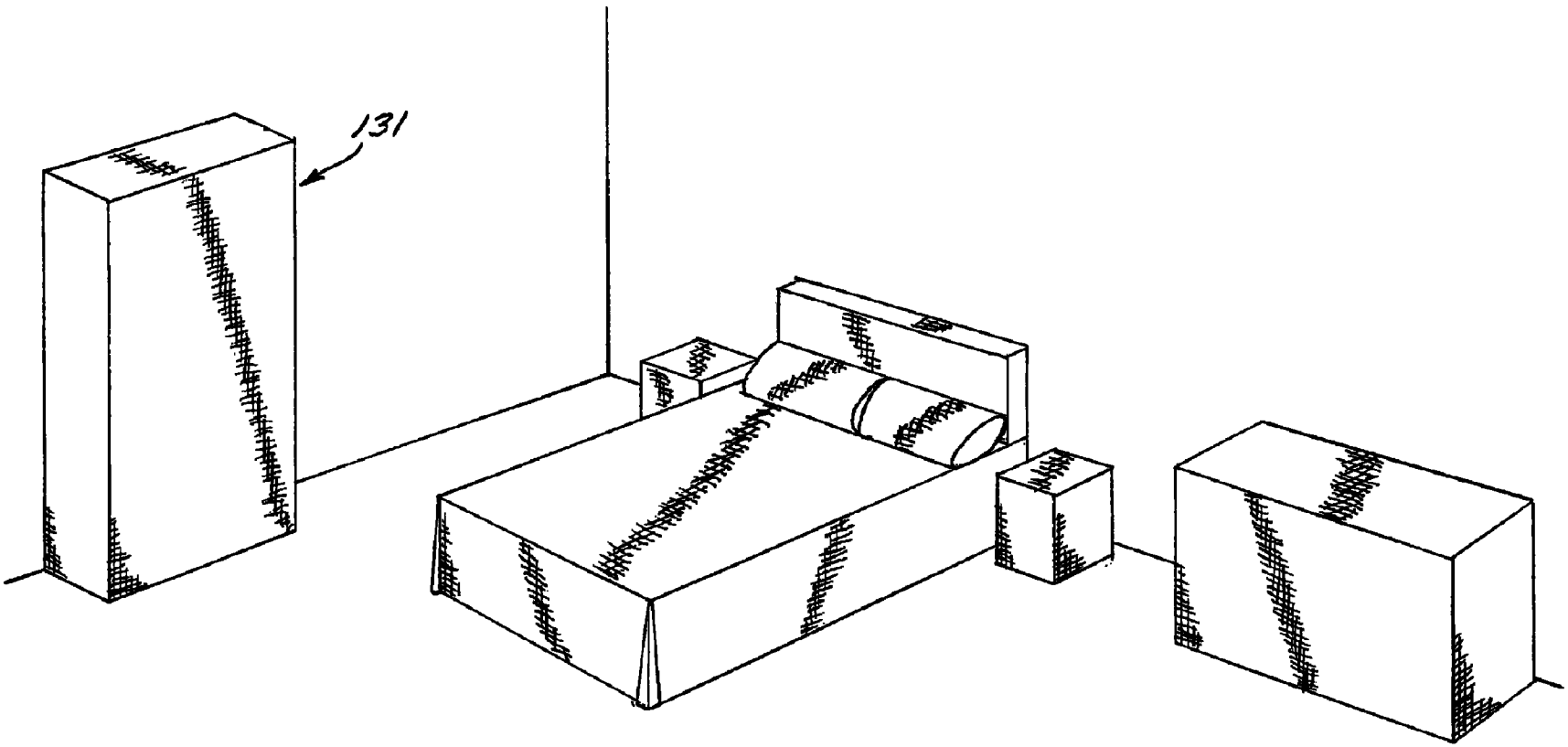
FIG. 36 is a perspective view of a bedroom layout displaying a simulated bed, armoire night stands and dresser as described above but in reduced scale.

Referring to FIGS. 34 and 35, in some of our embodiments, we employ three stacks of flanking desk leg tubular blanks 83 capped top and bottom by the caps 61 and assembled to, when covered simulate an armoire 131 as shown in FIG. 36.

We also elect to, in this embodiment, incorporate four erected tubular blanks 83 arranged in flanking relationship to form a row as shown in FIG. 35 and to be covered by a fitted cover to simulate a dresser, generally designated 135 (FIG. 36).

Figure 7:
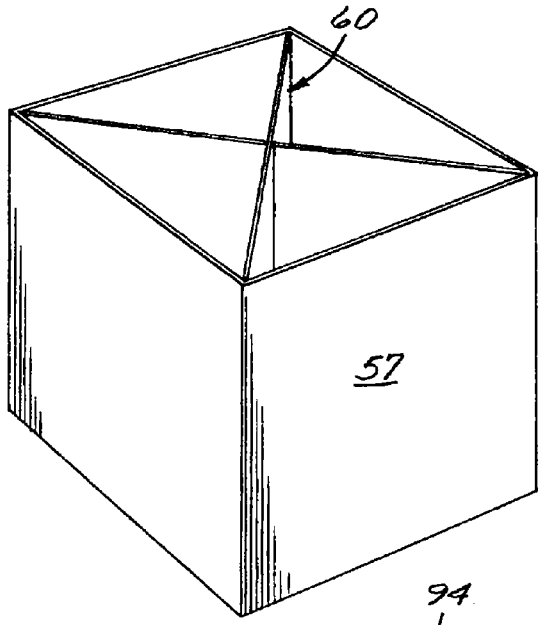
FIG. 7 is a perspective view of the erected tube shown in FIG. 4 but with the reinforcing insert of FIG. 6 inserted.
Figure 8:
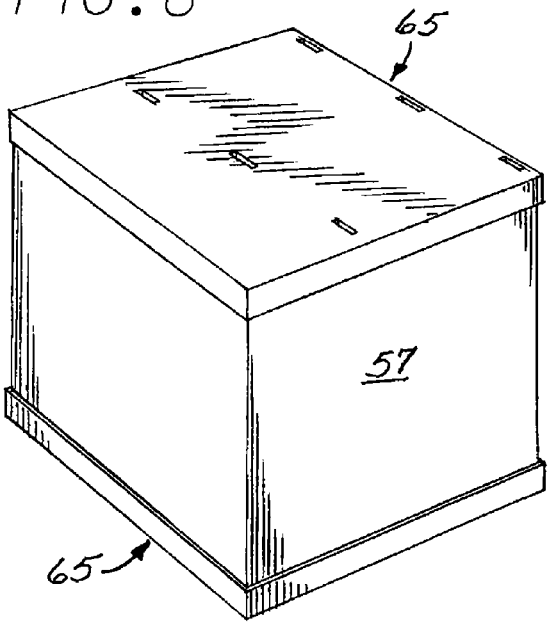
FIG. 8 is a perspective view similar to FIG. 4 but showing the tube capped at its opposite ends with caps like that shown in FIG. 5.

In operation, it will be appreciated that the system of blanks for the staging pieces of the present invention are generally fully collapsible to a flat condition thus rendering them readily storable and transportable to the staging site typically with just one workman. For those embodiments constructed of corrugated cardboard the blanks are lightweight and fairly stiff to be easily folded along the fold lines. Once at the site, the components can be readily erected, the end flaps or end caps easily installed to cooperate in holding the leg pieces or chair parts in their vertical positions. The vertical orientations of, for instance, the walls of the blanks 57 shown in FIGS. 7 and 8, particularly with the reinforcing inserts 60 installed, provide significant column strength under compression such that should customer happen to sit on the staging piece his or her weight will be supported up to several hundred pounds. While the tubular components may be constructed on numerous different materials such as plastic, corrugated cardboard has been discovered to be a particularly practical material in that it is lightweight, durable, has substantial structural integrity and renders the product reusable may times over.

Figure 20:
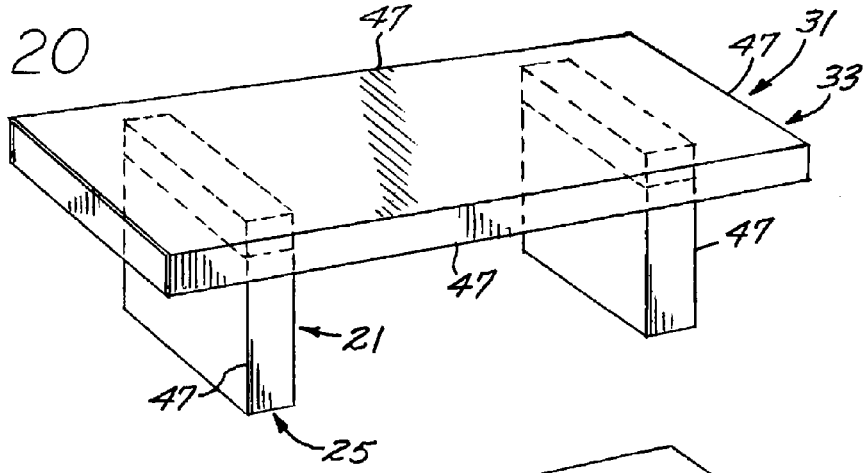
FIG. 20 is a perspective view of a console constructed from the erected blank shown in FIG. 19.
Figure 32:
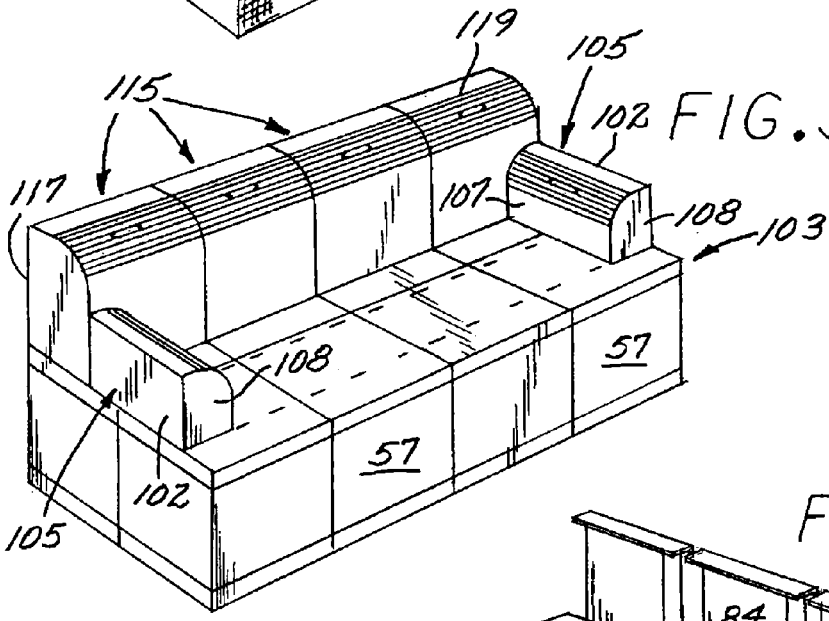
FIG. 32 is a front perspective view of a simulated couch incorporating the erected back elements and erected back blanks and arm rest blanks shown in FIGS. 8 and 12, but in reduced scale.

In any event, once the components are erected and assembled in the desired configurations such as, for the chair shown in FIG. 28, love seat shown in FIG. 30, couch shown in FIG. 32, bed shown in FIG. 33, console shown in FIG. 20 or desk shown in FIG. 21, the mannequin provided by the components can be draped with the coverings indicated to thus provide an authentic appearance to the staging pieces. Because of the inexpensive construction and flexibility in assembly, the method provides an economical and convenient means for staging furniture for many different rooms and many different styles and tastes.

As will be appreciated by those skilled in the art, the method of the present invention provides a particularly economical and effective staging procedure which is convenient to use and can readily be adapted to many different styles and tastes with only a minimum of capital investment for the initial pieces and minimal investment for the modifications thereto.

We claim:

1. A method for staging furniture pieces of desired configurations, including:

for each furniture piece, selecting a plurality of flat tubular foldable blanks having fold lines positioned and arranged so the blanks can be folded there along to form open tubes of selected configurations to simulate respective components of the respective furniture pieces;

selecting at least one end cap for the respective tubes;

at a staging location, unfolding the blanks along the fold lines to form the respective tubes;

erecting the tubes;

placing the caps on selected ends of the respective tubes;

combining the tubes together to form respective mannequins simulating the profiles of the respective furniture pieces;

selecting covers to fit over at least some of the mannequins to cooperate in simulating the respective furniture pieces; and placing the covers over at least the respective mannequins.

2. The method of claim 1 that includes:

selecting at least some of the blanks to include flaps on the respective selected ends thereof; and folding the flaps over to from the respective end caps.

3. The method of claim 1 that includes:

selecting cruciform reinforcing inserts sized to be received in at least some of the tubes; and inserting the inserts in the at least some of the tubes.

4. The method of claim 1 for staging with at least one of the furniture pieces being a table and wherein:

the selecting of a plurality of flat foldable tubular blanks includes selecting a pair of blanks to simulate respective vertical table legs having predetermined horizontal cross sectional configurations and the selecting of another of the flat foldable blanks includes selecting a tubular blank having fold line positioned and configured to, when folded, form a tubular table top with a bottom wall configured with openings of the predetermined cross sectional configuration; and attaching the respective legs to the table top by insertion of the respective one ends thereof into the respective openings.

5. The method of claim 1 wherein:

the selecting of the flat foldable tubular blanks step includes selecting at least a pair of blanks having a fold lines to the at least a pair of blanks may be folded to form table legs of predetermined horizontal configurations and the selecting of a plurality of foldable blanks further includes selecting a foldable blank having fold lines positioned and configured it may be folded to a tubular configuration having top and bottom walls to form a table top, and the bottom wall having respective cut outs to form openings of the predetermined configuration to slidably receive one extremity of the respective legs.

6. The method of claim 1 that includes:

selecting at least some of the end caps in the form of flat tubular blanks having fold lines configured so they may be folded along the fold lines to form peripheral walls configured to be received over the selected ends of at least some of the tubes.

7. The method of claim 6 that includes:

selecting the end cap blanks with end walls configured with elongated slots disposed in a selected pattern; and at least some of the foldable blanks are selected with respective tabs projecting from the ends opposite the respective tubular selected ends thereof for, when the at least some of the foldable tubular blanks are folded into the respective tubes, projecting therefrom in the selected pattern to be slidably received in the respective slots.

8. The method of claim 1 wherein:

the step of selecting the flat tubular blanks includes selecting the blanks with fold lines arranged so, when unfolded, the blanks will form a quadrangular.

9. The method of claim 1 wherein:

the step of selecting the plurality of flat foldable tubular blanks includes selecting at least six of the blanks having a length of about 18 inches;

the step of erecting the tubes includes erecting them so that they project vertically substantially 18 inches and further includes positioning at least some of the tubes in juxtaposition in adjacent rows of three tubes;

the step of selecting caps includes selecting flat cap blanks including fold lines for folding of the cap blanks to form respective end walls and peripheral walls configured to be received in sliding relationship over the opposite ends of the respective of at least some of the tubes;

selecting a reinforcing inserts configured and shaped to be received longitudinally in the tubes;

placing the inserts in the tubes;

placing the end caps on the opposite ends of the respective at least some of the tubes;

the step of selecting the plurality of flat foldable tubular blanks includes the further step of selecting chair, back blanks formed with folds configured in shape so that, upon folding the back blanks they are sized to be complementally mounted on one of the rows of the at least some of the tubes;

folding the back blanks into the back tubes; and surmounting the back tubes on one of the rows of the at least some of the tubes.

10. The method of claim 9 wherein:

the step of selecting plurality of the foldable tubular blanks includes selecting foldable blanks formed with fold lines constructed and arranged such that, when folded along the respective fold lines, will be sized and configured to act as arm rests; and the step of combining the tubes includes surmounting the arm rest tubes on the opposite ends of one of the rows of at least some of the tubes.

11. The method of claim 1 that includes:

selecting the tubular blanks as being constructed of corrugated cardboard.

12. The method of claim 1 that includes:

selecting covers fitted to complementally fit over the mannequins; and fitting the covers on the respective mannequins.

13. The method of claim 1 wherein:

the step of selecting of a plurality of flat tubular foldable blanks includes selecting blanks configured to, when erected, act as and wherein:

the method includes selecting a plurality of table top blanks formed at their opposite respective with respective fold lines to, when folded define aprons at the opposite extremities;

at the staging site, erecting the some of the flat tubular foldable blanks to form the desk legs and positioning a plurality of such desk legs in flanking relationship; and placing the top panels on the legs and folding the top panels along the fold lines to form the aprons.

14. The method as set forth in claim 13 wherein:

the step of selecting the table top blanks includes selecting table top blanks including integral rings at the respective fold lines for cooperating in forming through elongated passages; and inserting dowels in the through passages to cooperate in supporting the top blanks.

15. A method of staging furniture pieces of desired configuration including:

a plurality of foldable tubular blanks having fold lines positioned and arranged so that the blanks can be folded to form vertical tubes of selected configurations to simulate respective components of the respective furniture pieces;

selecting at least one cap for the respective tubes;

at a staging location unfolding the blanks along the fold lines to form respective tubes;

erecting the tubes;

selecting a plurality of foldable blanks having fold lines to, when unfolded, form caps having end walls and short peripheral walls configured for slidable receipt over one end of the respective tubes;

inserting the caps over the respective one ends of the respective tubes, and positioning the tubes together to combine in defining a mannequin representative of the piece of furniture;

draping the mannequin with a cover to cooperate in simulating the piece of furniture.

16. The method of claim 15 for forming a furniture piece simulating a table and wherein:

the selecting of the plurality of flat foldable tubular blanks includes selecting at least a pair of blanks including the fold lines arranged and configured so that when erected the blanks will form vertically projecting tubes defining table legs and wherein the method further includes:

selecting a top blank;

erecting the table legs and applying the caps to respective one ends;

deploying the table top blank and positioning it on the legs.

17. The method of claim 16 includes:

selecting the table top blank with aprons hingedly connected to the opposite sides thereof to be folded to a top collapsed position; and at the staging site unfolding the aprons and mounting the table top on the legs.

* * * * *